United States Patent [19]

Marik

[11] Patent Number: 4,631,745

[45] Date of Patent: Dec. 23, 1986

[54] ANALOG DIVIDER WITH MINIMAL PHASE DISTORTION

[75] Inventor: Charles J. Marik, Richmond, Ill.

[73] Assignee: Motorola, Inc., Schaumburg, Ill.

[21] Appl. No.: 727,936

[22] Filed: Apr. 26, 1985

[51] Int. Cl.[4] ..... H04H 5/00

[52] U.S. Cl. ..... 381/15; 307/492; 328/161; 364/850

[58] Field of Search ..... 328/145, 161; 307/490, 307/491, 492, 494; 364/849, 850; 381/15, 16

[56] References Cited

U.S. PATENT DOCUMENTS

| | | | |
|---|---|---|---|
| 4,004,141 | 1/1977 | Curtis | 307/492 |
| 4,157,512 | 6/1979 | Schmoock | 364/849 |
| 4,353,000 | 10/1982 | Noda | 307/490 |
| 4,371,747 | 1/1983 | Hilbert | 381/15 |
| 4,404,431 | 9/1983 | Watanabe | 381/15 |
| 4,439,696 | 3/1984 | Yokoya | 307/494 |

*Primary Examiner*—Forester W. Isen

*Attorney, Agent, or Firm*—Margaret Marsh Parker; James W. Gillman

[57] ABSTRACT

An analog divider circuit as for use in AM stereophonic receivers provides minimum phase variation with control voltage level change, by means of a feedback circuit. The division process is performed by subtracting logarithms of currents produced by the dividend and divisor voltages, then deriving the antilog of the difference or remainder. At the critical point in the process, where junction capacitances do not accurately track the change in the control level, cross-coupled capacitors stabilize the circuit by feeding back a signal from the circuit output to minimize any undesired phase changes.

6 Claims, 2 Drawing Figures

ANALOG DIVIDER WITH MINIMAL PHASE DISTORTION

BACKGROUND OF THE INVENTION

This invention relates to the field of divider circuits and, in particular, to analog dividers with minimized phase distortion.

Such a divider may also be termed a "variable gain amplifier" since the control voltage of the amplifier may be the "divisor" signal inverted.

One common fault in such circuits is a tendency for the output signal to include false phase information due to changes in the small signal resistance of the junctions, caused by changes in the control current. This fault is of particular significance when the divider circuit is to be used in an AM stereo receiver. In the AM sterophonic system wherein the signal can be expressed by the formula:

$$(1+L+R)\cos(w_c t+\phi), \text{ where } \phi=\tan^{-1}[(L-R)/(1+L+R)]$$

a typical receiver will, at one or more points in the circuit, divide a signal which contains cos $\phi$ by another signal such as cos $\phi$. This may be termed a "correction function", since the signal which is the quotient in the division process is typically a "corrected" or exact signal such as (L−R). The accuracy of the division process is significant, therefore, since the cos $\phi$ signal is a function of the phase modulation of the transmitted signal and any erroneous phase-related information added to the correction signal will obviously distort the audio output signals (L,R) of the receiver.

SUMMARY OF THE INVENTION

It is, therefore, an object of the present invention to provide an analog divider circuit having minimal phase distortion.

It is a particular object to provide such an improved divider circuit with minimal additional cost and complexity.

It is another particular object to provide such a divider circuit which is suitable for use in an AM stereo receiver.

These objects and others which will become apparent are provided in a divider circuit according to the present invention wherein cross coupled capacitors prevent phase shift in the output signal caused by non-tracking of junction capacitances as the control voltage or "divisor" signal changes.

DETAILED DESCRIPTION OF A PREFERRED EMBODIMENT

Figure 1:
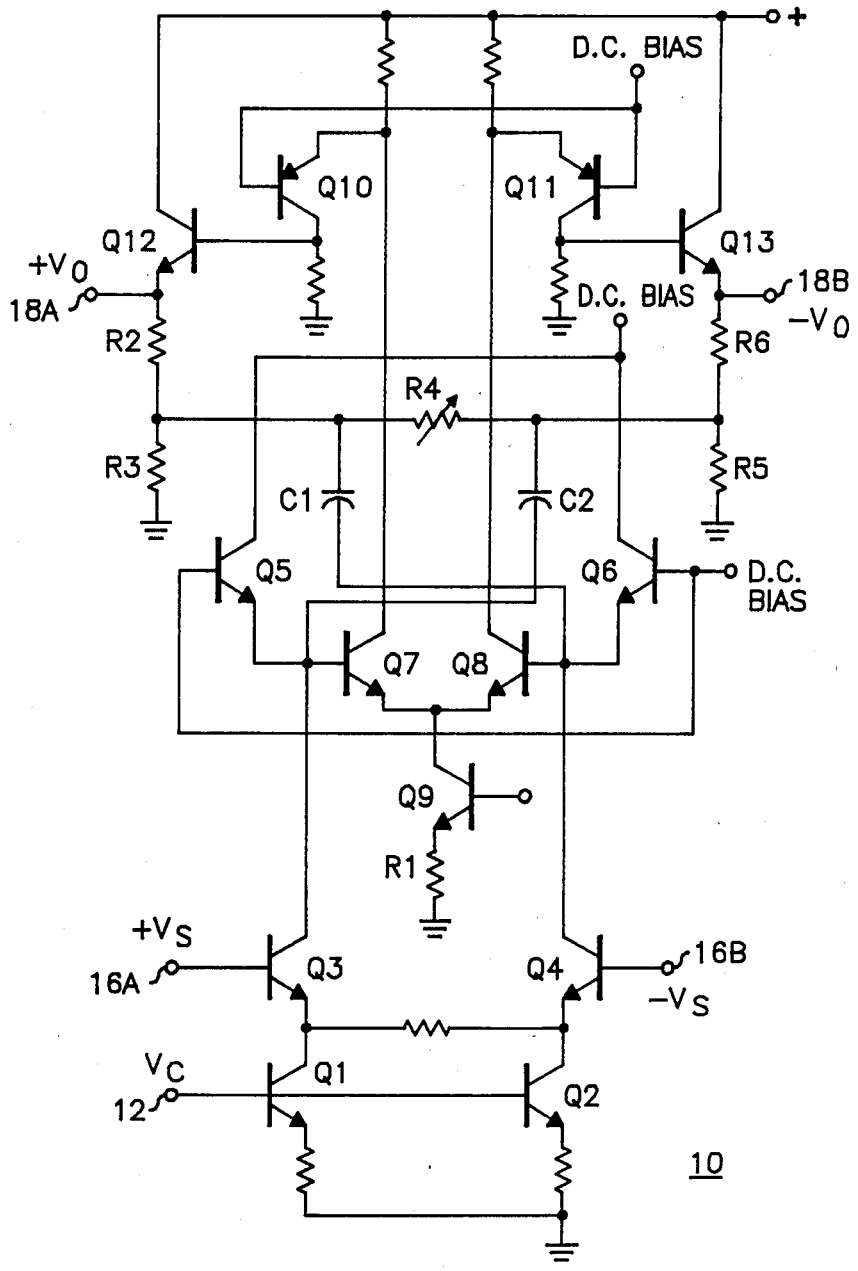
FIG. 1 is a schematic of a preferred embodiment of a divider in accordance with the present invention.

FIG. 1 shows a preferred embodiment of the analog divider 10 of the present invention. The control signal ($V_c$) at an input terminal 12 would be a "divisor" signal such as could be provided by an error amplifier 14 (see FIG. 2), sometimes termed a "cosine phase detector". It is to be noted that, although the present divider is shown in the environment of an AM stereophonic receiver, no limitation thereto is to be inferred or assumed. The design has value in any circuit requiring a divider having minimum phase variation with control level change.

The divisor signal from the terminal 12 is coupled to the bases of transistors Q1, Q2, and thereby controls the total current through a pair of transistors Q3, Q4. The input signal which is coupled from terminals 16A, 16B to the bases of Q3, Q4, respectively, is the signal to be divided, the "dividend" signal ($V_s$). In an AM stereo embodiment, the dividend signal would likely be (L−R) cos $\phi$ and the "divisor" signal would be cos $\phi$. The base inputs to Q3 and Q4 produce a differential signal current. The emitter-base junctions of two transistors Q5, Q6 produce voltages which are the logarithms of the currents fed to the respective junctions. Transistors Q7, Q8 then produce collector currents which are equal to the antilogarithms of the respective differential base voltages of transistors Q5, Q6. A transistor Q9 and a resistor R1 are coupled to the emitters of Q7, Q8, providing a current source.

The collector current from Q3, Q4 is thus seen to be a function of $V_s$ divided by $V_c$ since subtracting logarithms is the equivalent of a division process; i.e., log x−log y=log (x/y). To help reduce phase instability, this signal is then coupled to two grounded base transistor stages Q10, Q11 which are buffered by two emitter follower stages Q12, Q13. The emitters of Q12, Q13 provide the output signal $V_o=\pm kV_s/V_c$ at output terminals 18A, 18B.

The circuit as thus far described will function satisfactorily as an analog divider if phase distortion in the division process is of little or no concern. However, for the circuit to perform with a high degree of phase stability, the feedback or neutralization circuit as shown will be required. Without this feature, if the control signal $V_c$ is reduced by a factor of 2, the small signal resistances of the emitter-base junctions of Q5, Q6 are increased by a factor of 2, while the junction capacitances remain nearly constant. In this way, a certain amount of phase shift is added as the control voltage changes. This undesired effect can be prevented by using the network consisting of R2–R6, R4 being preferably a variable resistance, and with two capacitances C1, C2 cross-coupled from the ends of R4 to the opposite bases of transistors Q7, Q8, respectively. Now when the current is reduced, as by a factor of 2, the gain and the feedback are increased by a factor of 2, and the division process is an accurate one, introducing minimal phase distortion, if any.

It should be noted at this point that the choice of components in the feedback network may depend on the particular embodiment; e.g., an integrated circuit embodiment might use capacitors directly connected from Q7 to Q 13 and from Q8 to Q12, such capacitors having values considerably smaller than a picofarad. On the other hand, with discrete elements, capacitors in the range of 5–10 pf can be used to advantage in the feedback network as shown in FIG. 1.

Figure 2:
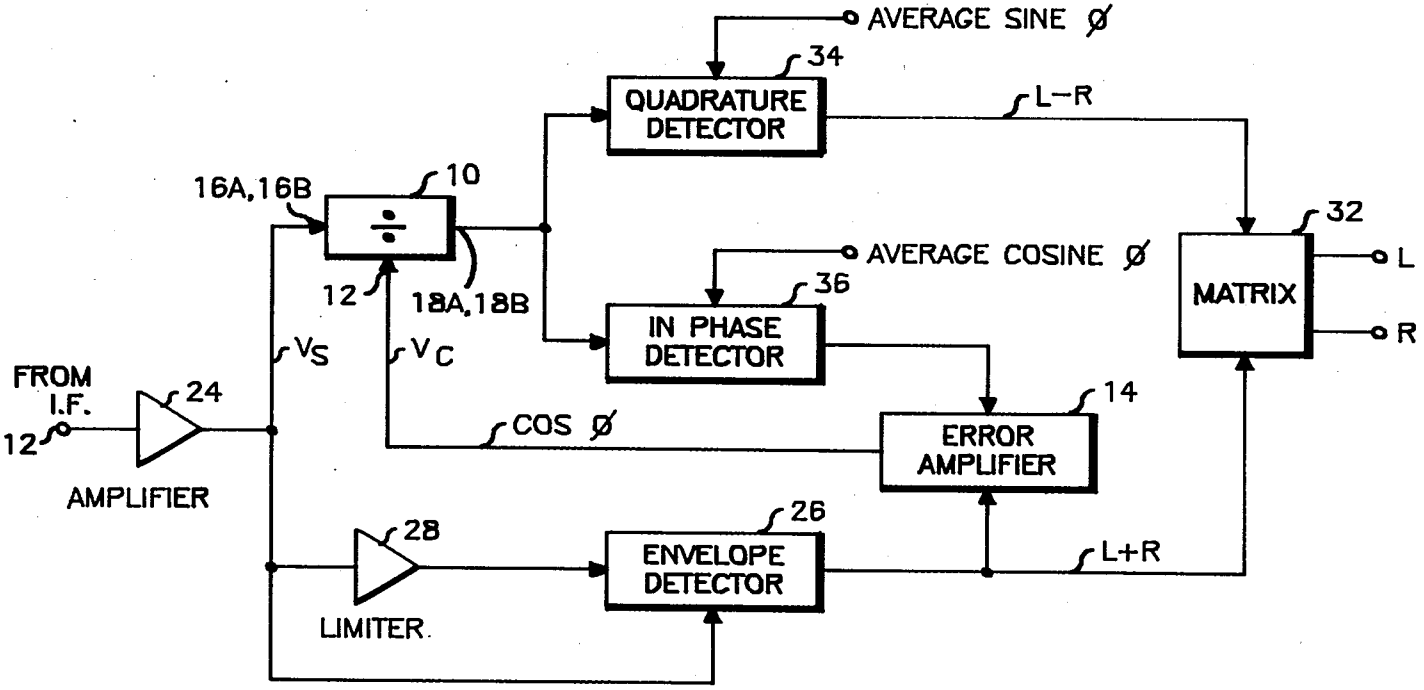
FIG. 2 is a block diagram of a portion of an AM stereophonic receiver utilizing the circuit of FIG. 1.

The block diagram shown in FIG. 2 is a portion of an AM stereo receiver which is only one of many such receivers which would benefit from the use of the analog divider 10 of the present invention. Naturally, there are many possible applications in other fields of analog circuitry.

In FIG. 2, the terminal 12 receives an AM stereophonic broadcast signal as given hereinabove which has been received and processed in the usual fashion in an RF stage and IF stage (not shown). The IF signal received at the terminal 12 is coupled through an amplifier 24 to an envelope detector 26, a limiter 28, and to the "dividend" inputs 16A,16B of the divider 10. The output signal of the limiter 28, modulated in phase only, is also coupled to the envelope detector 26. The output signal (L+R) of the envelope detector is coupled to a matrix 32 and to the error amplifier 14. In this embodiment, the input signal ($V_s$) of the divider 10 is a signal which has been distorted by a factor of cos $\phi$, due to the requirement for compatibility of all AM stereo signals with existing monophonic receivers. The undistorted output of the divider 10 is coupled to a quadrature ("Q") detector 34 and an in-phase ("I") detector 36. The detectors 34,36 also receive separate inputs from a VCO (not shown) of sin $\phi$ and cos $\phi$, respectively. These two signals are the unmodulated IF carrier frequency signals in quadrature; i.e. this cosine is an average cosine of the IF carrier at terminal 12, not the cosine factor for which correction is desired. The corrected output signal (L−R) from the quadrature detector 34 goes to the matrix 32.

Also coupled to the error amplifier 14 is the output signal of the in-phase detector 36 which has been forced to become L+R by the error signal coupled back from the error amplifier to the divider 10. The error amplifier 14 has produced this signal by comparing the true L+R signal from the envelope detctor 26 with the approximate L+R signal from the I detector 36, and coupling back the error signal which will correct the approximate signal. Since the correction is done in the divider 10, the input signal to the I and Q detectors is not distorted and the difference signal has also been forced to be "correct" or undistorted.

Thus there has been shown and described an analog divider circuit which will function without adding any significant amount of phase distortion during the division process. The circuit has been shown in the environment of an AM stereo receiver in accordance with a preferred environment, however, no limitation thereto is to be inferred or assumed. The design has value in any circuit requiring a divider having minimum phase variation with control level change. Other modifications and variations of the invention are possible and it is intended to include all such as fall within the scope of the appended claims.

I claim:

1. An analog voltage divider circuit comprising:

first input means for receiving an analog voltage signal;

second input means for receiving a control voltage signal;

first circuit means coupled to the first and second input means for providing signals which are functions of the logarithms of said analog voltage signal and of said control voltage signal, respectively, and producing a third signal which is a function of the difference between said logarithmic function signals;

second circuit means coupled to the first circuit means for deriving a fourth signal which is a function of the antilog of said third signal;

output means coupled to the second circuit means for providing a buffered output signal from said third signal; and passive feedback means coupled to the second circuit means and the output means for compensating for unwanted phase deviation due to non-voltage-tracking capacitances within the divider circuit.

2. An analog voltage divider circuit comprising:

first input means for receiving an analog voltage signal;

second input means for receiving a control voltage signal;

first circuit means coupled to the first and second input means for providing signals which are functions of the logarithms of said analog voltage signal and of said control voltage signal, respectively, and producing a third signal which is a function of the difference between said logarithmic function signals;

second circuit means coupled to the first circuit means for deriving a fourth signal which is a function of the antilog of said third signal;

output means coupled to the second circit means for providing a buffered output signal from said third signal and feedback means comprising a pair of capacitors coupling a voltage signal back from the output means to the second circuit means for compensating for unwanted phase deviation due to non-voltage-tracking capacitances within the divider circuit.

3. An analog voltage divider circuit according to claim 2 and wherein the feedback means further comprises a divider chain of resistances.

4. An analog voltage divider circuit according to claim 3 and wherein at least one element of the divider chain is variable.

5. An analog voltage divider circuit according to claim 2 and wherein the analog voltage signal is an AM stereo-related signal and the control voltage signal is a correction signal for said AM stereo-related signal.

6. An analog voltage divider circuit according to claim 5 and wherein said AM stereo-related signal may contain a distortion factor and the correction signal substantially removes said distortion factor.

* * * * *